US009296197B2

(12) United States Patent
Fujio et al.

(10) Patent No.: US 9,296,197 B2
(45) Date of Patent: Mar. 29, 2016

(54) PRINT PRODUCT PRODUCTION DEVICE

(75) Inventors: Noboru Fujio, Tokyo (JP); Hiroki Sezaki, Kanagawa (JP)

(73) Assignee: KABUSHIKI KAISHA TOKYO KIKAI SEISAKUSHO (JP)

( * ) Notice: Subject to any disclaimer, the term of this patent is extended or adjusted under 35 U.S.C. 154(b) by 428 days.

(21) Appl. No.: 13/550,874

(22) Filed: Jul. 17, 2012

(65) Prior Publication Data

US 2014/0021674 A1 Jan. 23, 2014

(51) Int. Cl.
*B41F 13/56* (2006.01)
*B42B 2/00* (2006.01)
*B41J 15/04* (2006.01)

(52) U.S. Cl.
CPC ..... *B41F 13/56* (2013.01); *B41J 15/046* (2013.01); *B42B 2/00* (2013.01)

(58) Field of Classification Search
CPC ..... B41F 13/56; B41F 13/60; B65H 29/66; B65H 45/28; B41J 15/165; B41J 15/046
USPC ..... 101/225, 226, 227, 228; 270/12, 13, 17, 270/52.09
See application file for complete search history.

(56) References Cited

U.S. PATENT DOCUMENTS 1,240,014 A * 9/1917 Bechman ..... 270/8
4,754,959 A * 7/1988 Kobler ..... B41F 13/54 270/21.1
5,105,279 A * 4/1992 Kamada et al. ..... 358/296
6,155,169 A 12/2000 Kacmarcik et al.
6,994,005 B2 * 2/2006 Lamothe ..... 83/156
8,011,297 B2 * 9/2011 Eckert et al. ..... 101/228
2003/0167943 A1 9/2003 Izawa et al.
2003/0189629 A1 10/2003 Tsuji et al.
2006/0005675 A1 * 1/2006 Scheffer et al. ..... 83/37
2006/0288891 A1 12/2006 Hunkeler et al.
2007/0063407 A1 3/2007 Langenegger et al.

(Continued)

FOREIGN PATENT DOCUMENTS

CN 1839082 9/2006
CN 2895346 5/2007

(Continued)

OTHER PUBLICATIONS

JPO Machine Translation of reference JP 2002-274737 published on Sep. 25, 2002.*

(Continued)

*Primary Examiner* — Jennifer Simmons
(74) *Attorney, Agent, or Firm* — Clark Hill PLC; James R. Foley

(57) ABSTRACT

A print product production device is installed such that a continuous paper guide path having gone through a digital printing unit from a continuous paper supply unit is installed to be branched at a downstream side of the digital printing unit, one continuous paper guide path is induced to a section formation unit, a section block formation unit and a second block folding-in-two unit are disposed at a downstream side of the section formation unit, and the other continuous paper guide path is installed to be induced to a sheet formation integration unit. An angle bar mechanism is installed at a branch part of the continuous paper guide path, and a continuous paper (W) can be optionally guided to any one of the one continuous paper guide path and the other continuous paper guide path after the branching.

11 Claims, 4 Drawing Sheets

(56) References Cited

U.S. PATENT DOCUMENTS

| | | | | |
|---|---|---|---|---|
| 2009/0080960 | A1* | 3/2009 | Yamamoto | 400/621 |
| 2011/0187802 | A1* | 8/2011 | Fujio et al. | 347/104 |
| 2011/0243634 | A1 | 10/2011 | Kagami et al. | |
| 2012/0049432 | A1* | 3/2012 | Fujio et al. | 270/20.1 |
| 2012/0122647 | A1 | 5/2012 | Sezaki et al. | |

FOREIGN PATENT DOCUMENTS

| | | | | |
|---|---|---|---|---|
| CN | 201186519 | | | 1/2009 |
| CN | 201253984 | | | 6/2009 |
| CN | 101758658 | | | 6/2010 |
| CN | 201647723 | | | 11/2010 |
| CN | 102529430 | | | 7/2012 |
| CN | 202321777 | | | 7/2012 |
| DE | 2513244 | C3 | | 10/1975 |
| DE | 8435466 | | | 4/1990 |
| DE | 102004043681 | | | 3/2006 |
| DE | 102007058650 | | | 7/2009 |
| DE | 102008002058 | | | 12/2009 |
| DE | 20321804 | | | 4/2010 |
| DE | 102010030267 | | | 12/2011 |
| EP | 1209000 | | | 5/2002 |
| EP | 2468668 | | | 6/2012 |
| EP | 2687378 | | | 1/2014 |
| JP | 2001-302067 | | | 10/2001 |
| JP | 2002-096969 | | | 4/2002 |
| JP | 2002193545 | A | * | 7/2002 |
| JP | 2002-274737 | | | 9/2002 |
| JP | 2003291440 | A | * | 10/2003 |
| JP | 2003341927 | A | * | 12/2003 |
| JP | 2007015859 | A | * | 1/2007 |
| JP | 2007076923 | A | * | 3/2007 |
| JP | 2009241262 | A | * | 10/2009 |
| JP | 2010-253677 | | | 11/2010 |

OTHER PUBLICATIONS

Helmut Kipphan; Handbuch der Printmedien; Technologien and Produktionsverfahren; Springer; Germany.
Drawing by Hunkeler "Anlagenkonfiguration" of Apr. 24, 2006 regarding part No. 7902.02585 for the end-user DB Services.
Jomni, Bakhita; "RotOcean (La Reunion) installe une presse Kodak Versamark VL4200"; Jun. 15, 2010; Available from: [http://www.industrie.com/impression/article/rotocean-la-reunion-instalie-une-presse-kodak-versamark-vl4200, 1192].
Kodak; "RotOcean offers same day publications"; Feb. 23, 2011; Available from: [https://www.youtube.com/watch?v=nZo9fiFk-hE].
Hunkeler; "Digital Newspaper Solution"; 2006.
Quotation by Hunkeler for Oce Deutschland GmbH dated Oct. 10, 2006.
Email from Mr. Stephan Klier/Hunkeler AG to Oce dated Oct. 20, 2006.
Hunkeler Drawing "Dispositionsplan" of Nov. 14, 2009 regarding part No. 7902.03527 for end-user Rotocean La Reunion.
Purchase order No. 7100454321 from Eastman Kodak Company to Hunkeler AG Paper Processing (Schweiz) of Dec. 11, 2009.
Confirmation of order No. 2020685 by Mr. Charles Verier (Hunkeler) to Eastman Kodak Co. of Dec. 16, 2009.
Invoice No. 6020284 dated Jan. 29, 2010 issued by Mr. Verier (Hunkeler) to Eastman Kodak Co. re. order No. 2020685.
Invoice No. 6022431 of Jul. 6, 2010 of Hunkeler AG to Eastman Kodak Co. re. order No. 2021967 of Mar. 12, 2010.
Technician report dated Jul. 1, 2010 from Hunkeler AG to Eastman Kodak Co. re. order No. 2021967 (work at Rotocean).
Engineer report from Hunkeler AG dated Jun. 25, 2010 to Eastman Kodak Co. re. order 2021967 of Mar. 12, 2010 (work at Rotocean).
Expenses claim of Mr. Peter Leiser dated Jun. 27, 2010 with enclosures.
Opposition to European Patent No. 22687378 filed by manroland web systems GmbH on Nov. 11, 2015.
Opposition to European Patent No. 22687378 filed by Hunkeler AG on Nov. 10, 2015.

* cited by examiner

PRINT PRODUCT PRODUCTION DEVICE

TECHNICAL FIELD

The present invention relates to a print product production device which may digitally print a print surface having a print size of a predetermined standard size on a continuous paper, cutting the digitally printed continuous paper into a cutting size of a predetermined standard size, producing a print product, for example, a print product such as a newspaper, obtained by folding and binding the cut paper sheets, digitally printing a print surface having a desired print size required on all such occasions on the continuous paper, and selectively producing a print product, for example, a direct mail or an advertisement, obtained by cutting the digitally printed continuous paper into a desired cutting size required on all such occasions.

BACKGROUND ART

In print products represented by newspapers or commercial print products, the same contents are mass-printed by using printing plates, and are transferred or distributed at costs or for free to carry out their mission.

Meanwhile, in the conventional printing fields, businesses have been done in well-versed printing fields such as pamphlet printing, book printing, and art book printing. Further, newspapers have arranged printing equipment in the companies separately from other printing fields to do businesses in the field of newspaper printing.

However, in recent years, newspapers are separating printing fields from the companies to establish printing companies or are introducing printings of other printing fields to do businesses, and printing companies, which have been irrelevant to newspapers, are being left in charge of the businesses of newspapers or are obtaining orders to introduce newspaper printing and do the businesses.

In this background, in recent years, for example, in the field of commercial printing, print products, such as individual direct mails, or pamphlets for customers of restricted regions, generations, or jobs, which have different individual contents, or a very small amount of print products are required. Likewise, even in the field of newspapers, including those covering various fields such as politics, economy, literature and arts, sports, hobbies, and entertainments, newspapers satisfying detailed tastes of readers, such as those restricting contents to the various fields, those for readers of restricted regions, generations, or jobs, or those having the characteristics of both, are increasingly requested. Further, digital printing is being highlighted as a printing method for producing a printing product corresponding to the request, and, for example, the following Patent Literatures 1 to 6 have suggested print product production methods and print product production devices.

A print product production method and a print product production device disclosed in Patent Literature 1 include (1) receiving digitally printed sheets through ink jet printing and the like or paper sheets obtained by cutting a digitally printed continuous paper one by one from a conveyor by a gripping unit or a receiving element such as a sucker and continuously carrying the sheets into a collection station, (2) overlapping the sheets in the collection station, (3) carrying out a stack body where a predetermined number of sheets are stacked from the collection station, (4) continuously carrying the succeeding printed sheets one by one into the collection station from which the stack body has been carried out, (5) carrying the stack body carried out from the collection station into a folding station, and (6) folding the stack body with the folding station and then carrying out the folded stack body from the folding station, and (1) to (6) are continuously performed by the stations.

A print product production method disclosed in Patent Literature 2 is substantially the same as that disclosed in Patent Literature 1. In detail, Patent Literature 2 is different from Patent Literature 1 in that a printed continuous paper is bisected in parallel to a continuous direction after dried, and that in the steps of (1) and (2), an intermittently rotated impeller mechanism is disposed in a collection station and sheets obtained by cutting a digitally printed continuous paper are discharged toward blades of the impeller horizontally to form a stack body, or sheets formed by cutting a digital printed continuous paper are sequentially inserted between the blades of the impeller where a plurality of blades are disposed circumferentially and a stack body is formed by dropping the corresponding sheets on a conveyor from the blades with an obstruction plate. Further, in the exemplary embodiment of Patent Literature 2, a print product production device by which the corresponding method can be performed is disclosed.

In a print product production method and a print product production device disclosed in Patent Literature 3, a digital printing system for printing a continuous paper, a side margin cutting station for cutting an unnecessary side margin of the continuous paper, a longitudinal cutting station for cutting the continuous paper longitudinally (parallel to the continuous direction), a transverse cutting station for cutting the continuous paper transversely (perpendicular to the continuous direction) to separate sheets, a removal unit for removing a defective product of the separated sheets having a detective printing part or a damage part from a processing path, a collection station for overlapping the sheets, a carrying unit for carrying a stack body of the sheets overlapped by the collection station to a transverse folding station, a transverse folding station for folding the stack body carried by the carrying unit transversely with respect to the carrying direction, a longitudinal folding station for folding the stack body in the carrying direction, a binding station for binding the folded stack body along a folding peripheral part, a second collection station for inserting signatures obtained by folding the stack body or folding and binding the stack body into each other, and a delivery station for delivering the finished print product are sequentially installed in parallel from an upstream side, and an unnecessary station is not operated according to the configuration and form of the produced print product, so that various types of print products which are different in aspects of configuration and form, in detail, a signature-shaped print product may be produced without stopping a continuous production process.

Further, in Patent Literature 3, by revealing a gazette number of an European patent, a rotary body mechanism for overlapping sheets on an outer circumferential surface thereof, where a plurality of pairs of claws arranged in parallel to an axis are installed and two claws in each pair alternately interpose sheets between the outer circumferential surface and the claws to hold the sheets is suggested as the collection station. Likewise, by revealing a gazette number of an European patent, a mechanism at least including a supply surface, a pair of initial folding rollers parallel to the supply surface and having axes parallel to each other, at least one pair of moving rollers having an axis perpendicular to the supply surface and installed at upper sides of the initial folding rollers, and linear knives which are folding blades disposed in parallel to the axis of the initial folding roller, where a sheet stack body positioned horizontally on the supply surface and carried is supplied between the initial folding roller pairs by pushing the sheet stack body upward to a part folded by the linear knife, the two initial folding rollers interpose the pushed sheet stack body to be rotated about an axis while forming an imperfectly folded part so as to deliver the sheet stack body to at least one pair of moving rollers disposed above the initial folding rollers, and at least one moving roller interposes the folded part to be rotated while forming a perfectly folded part so as to deliver the sheet stack body in parallel to the axis of the initial folding roller is suggested as one or both of the transverse folding station and the longitudinal folding station.

In a print product production method disclosed in Patent Literature 4, when a print product is a newspaper of a broadsheet size, a newspaper surface of a broadsheet size whose two surfaces are parallel to each other in the widthwise direction of the continuous paper by making the widthwise direction parallel to the widthwise direction of the continuous paper are repeatedly printed by a digital printing unit by making the newspaper surface parallel to the continuous direction of the continuous paper by a predetermined number, the continuous paper is sent to a downstream side to adjust the printed newspaper surface and cut the newspaper into a lengthwise size of the newspaper surface of the broadsheet side in parallel to the widthwise direction, and is scored to a center of the widthwise direction of the cut paper, the scored paper is sequentially hung so that the folding points thereof is matched with a rear portion of the collation chain, and the folded points of the plurality of papers hung on the collation chain pushed upward by a discharge member while being overlapped and is sandwiched to a counterpart carrying conveyor into two, and then is guided to a chopper folding mechanism to make a folding-in-four broadsheet size newspaper, and when a print product is a newspaper of a tabloid size which is a half size of the broadsheet size, a newspaper surface of a tabloid size which are parallel in two surfaces in the continuous direction of the continuous paper by making the lengthwise direction parallel to a widthwise direction of the continuous paper is disposed in parallel in the widthwise direction of the continuous paper, the continuous paper repeatedly printed by a digital printing unit by making the continuous direction of the continuous paper by a predetermined number is sent to a downstream side to be matched with a printed newspaper surface and is cut in parallel to the widthwise direction by a length twice as long as the width size of the newspaper surface of the tabloid size, and is scored to a center of the widthwise direction of the cut paper, the scored paper is sequentially hung so that the folding points thereof is matched with a rear portion of the collation chain, and the folded points of the plurality of papers hung on the collation chain pushed upward by a discharge member while being overlapped and is sandwiched to a counterpart carrying conveyor into two and is guided to a cutting and binding station, and is cut along the scored folded point to form a cut sheet stack body where a second surface of the newspaper of the tabloid size whose widthwise direction is parallel to the cut marginal part, and if necessary, a center of the arrangement direction of the second surface of the newspaper surface of the stack body is bound along a direction perpendicular to the cut marginal part and is guided to a chopper folding mechanism so that a center of the arranging direction of the second surface of the newspaper of the stack body is chopper-folded along a direction perpendicular to the cutting marginal part with the chopper folding mechanism to form a newspaper of a folding-in-two tabloid size.

In other words, Patent Literature 4 discloses production of a folding-in-four print product having a print surface matching with a width size of a continuous paper and a folding-in-two print product having a print surface matching with a size of a half of a width size of a continuous paper. Further, in the exemplary embodiment of Patent Literature 4, a print product production device by which the corresponding method can be performed is disclosed.

Meanwhile, Patent Literatures 5 and 6 disclose print product production devices for ink jet printing a continuous paper, cutting the continuous paper to form a sheet-shaped print product, and integrating the print product in an integration unit. Further, Patent Literature 5 discloses that a cutting length (moving direction length of a continuous paper) of a sheet formed to correspond to a size of the print surface is changed.

CITATION LIST

Patent Literature

[Patent Literature 1] Japanese Patent Application Laid-Open (JP-A) No. 2002-193545
[Patent Literature 2] JP-A No. 2003-341927
[Patent Literature 3] JP-A No. 2007-15859
[Patent Literature 4] JP-A No. 2007-76923
[Patent Literature 5] JP-A No. 2003-291440
[Patent Literature 6] JP-A No. 2009-241262

SUMMARY OF INVENTION

Technical Problem

However, the print product production methods and devices, by digital printing suggested until now as disclosed in Patent Literatures 1 to 6 are directed to production of a print product obtained by cutting a printed continuous paper into individual sheets, carrying the sheets, overlapping an outer line of the first folding and an inner line to stack the sheets after folding the sheets first while the sheets are flat, guiding the sheets to a chopper folding mechanism while the sheets are stacked to perform chopper folding, and producing the chopper folded print product, that is, a signature-shaped print product folded by overlapping a plurality of sheets, which are disclosed in Patent Literatures 1 to 4, or production of a single sheet-shaped print product by cutting a printed continuous paper to form print products having individual sheet shape, and integrating the print products in the integration unit, which are disclosed in Patent Literatures 5 and 6.

Accordingly, when both a signature-shaped print product folded by overlapping a plurality of sheets and a single sheet-shaped print product are to be produced, both the print product production device as disclosed in any one of Patent Literatures 1 to 4 and the print product production device as disclosed in anyone of Patent Literatures 5 and 6 are necessary, increasing initial costs for equipment. Further, since sufficient working spaces are secured at peripheries of the units and the units need to be installed in a separate production line, a relatively wide installation area is required to be secured according to the related art.

The present invention has been made in an effort to solve the above problems of the related art, and an object thereof is to provide a print product production device which can be installed in a relatively small installation area without increasing initial costs for equipment and can produce both a signature-shaped print product folded by overlapping a plurality of sheets and a single sheet-shaped print product.

Solution to Problem

The present invention is for achieving the object with the configurations described in the claims. That is, the present invention provides a print product production device including: a continuous paper supply unit; a digital printing unit; a section formation unit; a section block formation unit; a section block folding-in-two unit; and a sheet formation integration unit, the print product production device being configured to guide the continuous paper of the continuous paper supply unit to the units via a continuous paper guide path and process the continuous paper, wherein the continuous paper guide path having gone through the digital printing unit from the continuous paper supply unit is branched at a downstream side of the digital printing unit, one continuous paper guide path is induced to the section formation unit, and the section block formation unit and the section block folding-in-two unit are disposed at a downstream side of the section formation unit, and the other continuous paper guide path is installed to be induced to the sheet formation integration unit.

In the print product production device according to the present invention, an angle bar mechanism is installed at a branch part of the continuous paper guide path, and the continuous paper can be optionally guided to any one of the one continuous paper guide path and the other continuous paper guide path after the branching.

In the print product production device according to the present invention, the section formation unit includes a jaw folding mechanism having a cutting cylinder driven and rotated about axes parallel to each other, a folding cylinder, and a jaw cylinder, and a first stage is executed by jaw folding through a cooperation of the folding cylinder and the jaw cylinder to form a section.

In the print product production device according to the present invention, the operation in which the number of overlapping sheets constituting the section can be designated, and the first stage is executed by the jaw folding through the cooperation of the folding cylinder and the jaw cylinder of the section formation unit to form the section is executed when the folding cylinder is rotated by the same number as the number of overlapping sheets constituting the designated section, after the operation in which a preceding section is formed.

In the print product production device according to the present invention, an outer circumferential length of the folding cylinder is integer times as long as a cutting length by which the continuous paper is cut into sheets, and when the first stage is executed by the jaw folding through the cooperation of the folding cylinder and the jaw cylinder to form the section, sections the number of which amounts to the integer for one rotation of the folding cylinder are continuously formed.

In the print product production device according to the present invention, an outer circumferential length of the folding cylinder is integer times as long as a length by which the continuous paper is cut, and when the first stage is executed by the jaw folding through the cooperation of the folding cylinder and the jaw cylinder to form the section, sections the number of which amounts to the integer for one rotation of the folding cylinder are continuously formed, and the section block formation unit includes section block formation mechanisms the number of which amounts to the integer, and the section block formation mechanisms form a section block together.

The print product production device according to the present invention further includes a designation means for designating the number of overlapping sheets constituting the section, and an operation in which a first stage is executed by jaw folding through a cooperation of the folding cylinder and the jaw cylinder in the section formation unit to form a section is executed whenever the folding cylinder is rotated by the same number as the number of overlapping designated sheets.

In the print product production device according to the present invention, in the sheet formation integration unit, a sheet formation mechanism having a rotary blade which can be driven and rotated about an axis perpendicular to a direction where the continuous paper guided to a continuous paper guide path is guided and parallel to the paper surface of the continuous paper and installed to exceed a paper width of the continuous paper, and a fixing blade installed to exceed a paper width of the continuous paper on an opposite side of the rotary blade by sandwiching the continuous paper guide path, a sheet stacking mechanism installed at a downstream side of the sheet formation mechanism, and a carrying mechanism for carrying the sheet formed by the sheet forming mechanism toward the sheet stacking mechanism are installed, and sheets are formed by cutting the continuous paper to be substantially parallel to a widthwise direction of the continuous paper at a location where the rotary blade is rotated to approach the fixing blade closest, and the sheets are stacked by the sheet stacking mechanism.

Further, in the print product production device according to the present invention, the sheet formation mechanism relatively changes a rotating speed of the rotary blade with respect to a movement speed of the continuous paper moving along the guide path of the continuous paper to change a cutting length (a length of the continuous paper in the movement direction) of the formed sheets.

In the print product production device according to the present invention, the sheet stacking mechanism has a sheet stacking space where a bottom surface and two side surfaces perpendicular to the bottom surface and perpendicular to each other are restricted by restricting members and an upper side is released, and a side surface restricting location by the restricting member of the restricting members of the two side surfaces which restricts at least a downstream side of the sheet in the carrying direction can be changed.

Further, in the print product production device according to the present invention, the sheet stacking mechanism can move the bottom surface restricting member upward and downward.

Further, in the print product production device according to the present invention, the sheet stacking mechanism can displace at least a downstream location of the bottom surface restricting member in the carrying direction of the sheet upward and downward.

Advantageous Effects of Invention

According to the print product production device according to the present invention, since the continuous paper supply unit and the digital printing unit can be used in both production of a signature-shaped print product folded by overlapping a plurality of sheets and production of a single sheet-shaped print product by branching a continuous paper guide path having gone through the digital printing unit from the continuous paper supply unit to a downstream side of the digital printing unit to install the continuous paper guide path, disposing a production mechanism for a signature-shaped print product folded by overlapping a plurality of sheets at a downstream side of one continuous paper guide path, and disposing a production mechanism for a single sheet-shaped print product at a downstream side of another continuous paper guide path, initial costs for equipment can be relatively reduced. Further, since a production device of a signature-shaped print product folded by overlapping a plurality of sheets and a production device of a single sheet-shaped print product need not be installed in separate production lines, the print product production devices can be installed in a relatively narrow installation area. Further, other effects of the present invention will be mentioned in the following description.

DESCRIPTION OF EMBODIMENTS

Hereinafter, an exemplary embodiment suitable for carrying out the present invention will be described with reference to the drawings. Further, the following exemplary embodiment does not limit the inventions according to the claims and all of the combinations of the features described in the exemplary embodiment are not essential for the technical solutions of the present invention.

Figure 1:
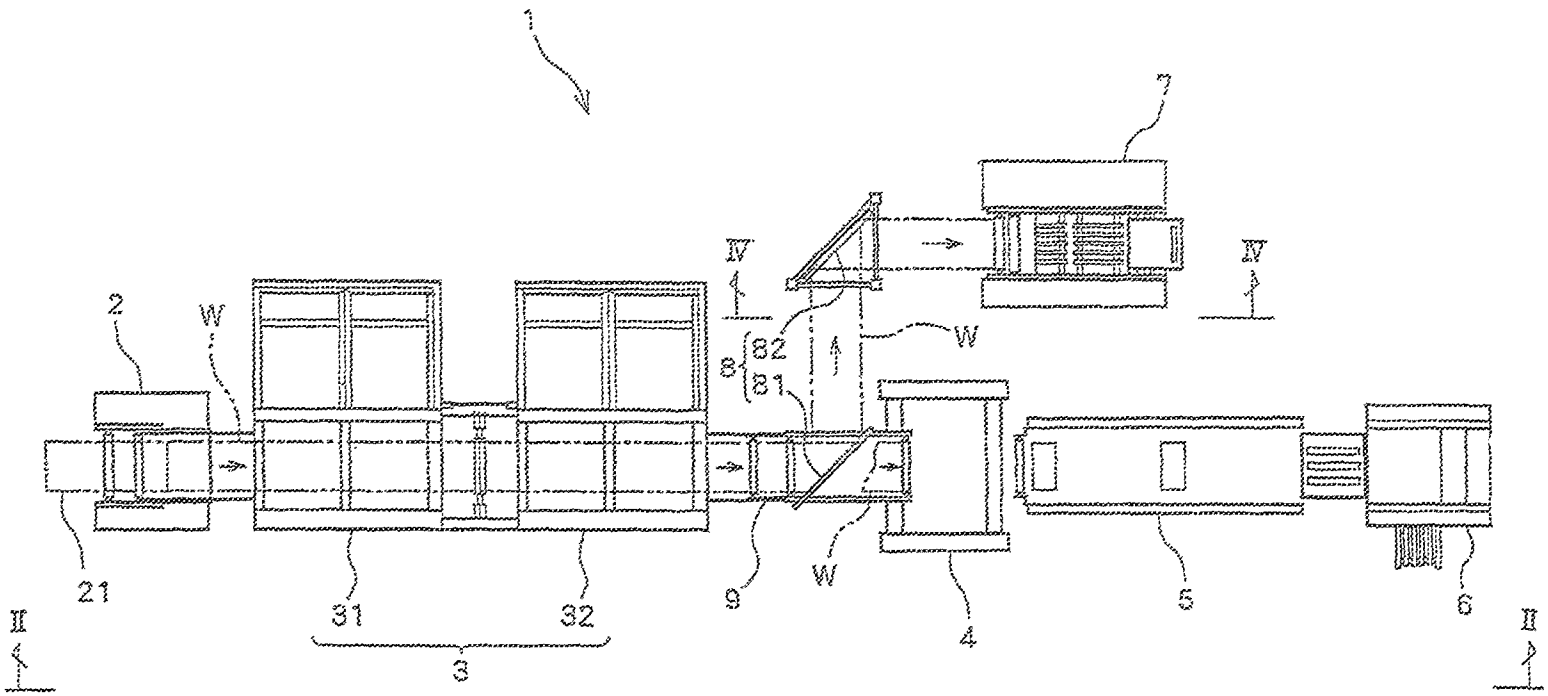
FIG. 1 is a plan view showing an entire configuration of a print product production device according to an exemplary embodiment.
Figure 2:
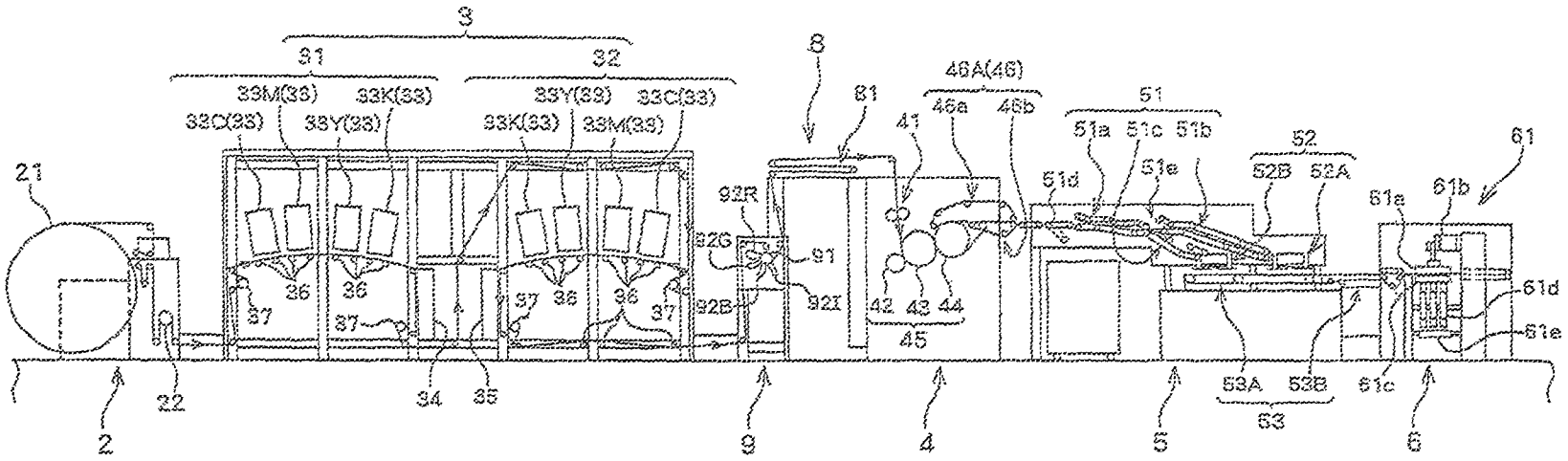
FIG. 2 is a skeleton diagram viewed along arrow II-II of the print product production device shown in FIG. 1.
Figure 3:
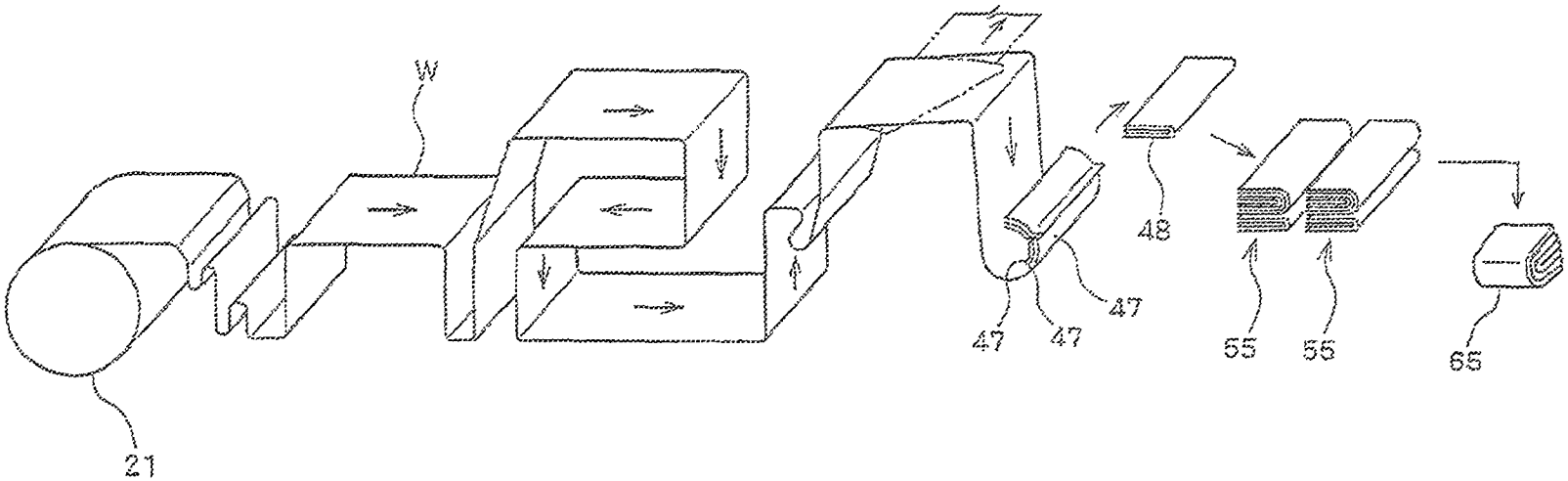
FIG. 3 is a perspective view showing a process of producing a signature-shaped print product from a continuous paper with the print product production device shown in FIG. 2, with reference to a shape of a paper.
Figure 4:
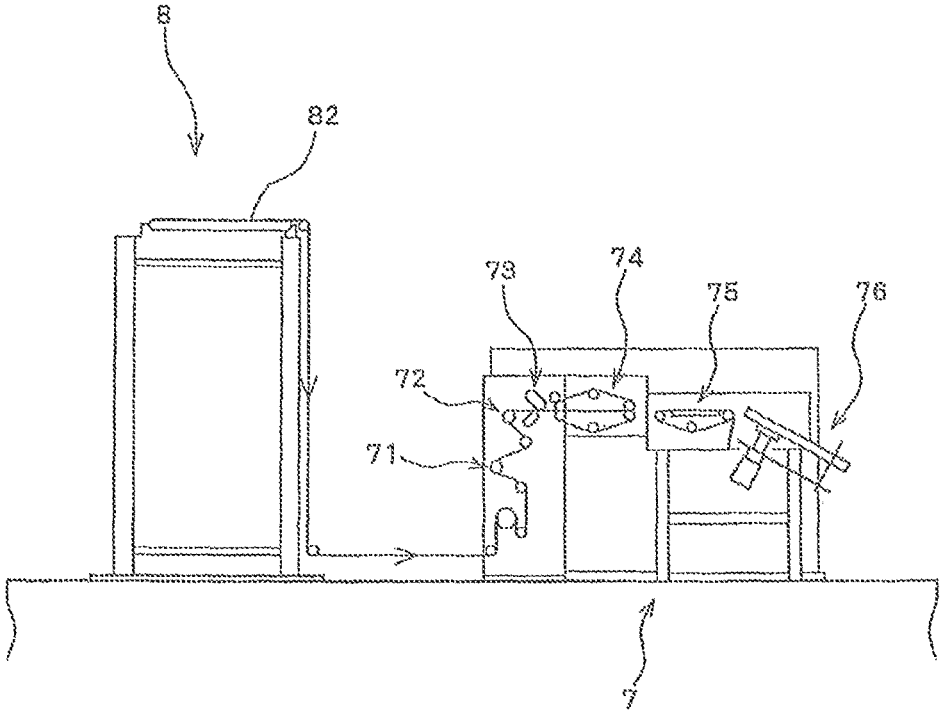
FIG. 4 is a skeleton diagram viewed along arrow IV-IV of the print product production device shown in FIG. 1.
Figure 5:
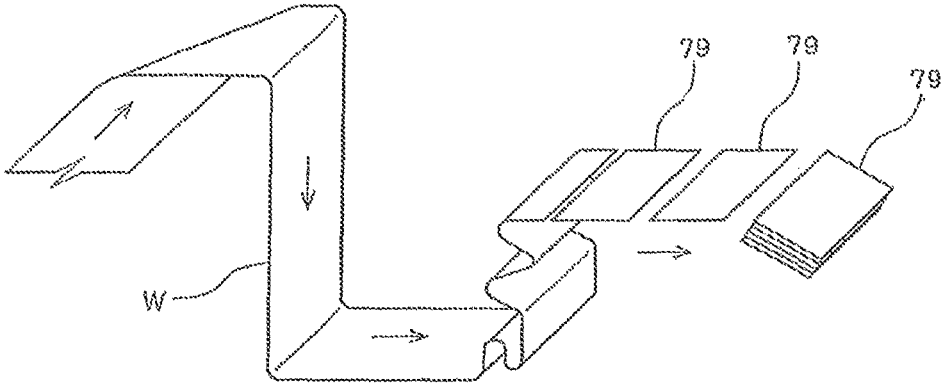
FIG. 5 is a perspective view showing a process of producing a single sheet-shaped print product from a continuous paper with the print product production device shown in FIG. 4, with reference to a shape of a paper.

FIG. 1 is a plan view showing an entire configuration of a print product production device according to an exemplary embodiment. FIG. 2 is a skeleton diagram viewed along arrow II-II of the print product production device shown in FIG. 1. FIG. 3 is a perspective view showing a process of producing a signature-shaped print product from a continuous paper with the print product production device shown in FIG. 2, with reference to a shape of a paper. FIG. 4 is a skeleton diagram viewed along arrow IV-IV of the print product production device shown in FIG. 1. FIG. 5 is a perspective view showing a process of producing a single sheet-shaped print product from a continuous paper with the print product production device shown in FIG. 4, with reference to a shape of a paper.

A print product production device 1 according to the present exemplary embodiment includes, at least, a continuous paper supply unit 2, a digital printing unit 3, a section formation unit 4, a section block formation unit 5, a section block folding-in-two unit 6, and a sheet formation integration unit 7. Between an upstream unit group including the continuous paper supply unit 2 and the digital printing unit 3, and a downstream unit group including the section formation unit 4, the section block formation unit 5, the section block folding-in-two unit 6, and the sheet formation integration unit 7, an angle bar mechanism 8 for branching a continuous paper guide path extending from the continuous paper supply unit 2 to the downstream unit group via the digital printing unit 3 is installed. Further, in the present exemplary embodiment, on a downstream side of the angle bar mechanism 8, a first downstream unit row where the section formation unit 4, the section block formation unit 5, and the section block folding-in-two unit 6 are sequentially disposed in series from an upstream side, and a second downstream unit row where the sheet formation integration unit 7 is disposed are installed in parallel. Further, in the present exemplary embodiment, a print paper surface monitoring unit 9 is installed immediately behind the digital printing unit 3.

Further, the shown print paper surface monitoring unit 9 is a component capable of monitoring only one print paper surface of a continuous paper W, and it is apparent that two print paper surface monitoring units are installed if it is necessary to monitor both opposite surfaces of a print paper. Further, when it is useless to monitor a surface of a print paper, it is not necessary to install a print paper surface monitoring unit.

The continuous paper supply unit 2 may support a paper roll 21 in a rotatable and rotation-damping-capable manner where the continuous paper W is wound to have a roll shape. Further, the continuous paper supply unit 2 includes an in-feed mechanism 22 which can carry the continuous paper W to a downstream unit while adjusting a running tension of the continuous paper W.

The digital printing unit 3 includes a first printing mechanism area 31 for printing one surface of the continuous paper W, and a second printing mechanism area 32 for printing an opposite surface of the continuous paper W. In the present exemplary embodiment, the digital printing unit 3 is a single path ink jet printing unit including an ink jet printing mechanism 33 having a line head type ink jet head including an ink discharge area corresponding to a width of the continuous paper W in both the first printing mechanism area 31 and the second printing mechanism area 32. Both the first printing mechanism area 31 and the second printing mechanism area 32 include a cyan ink-dedicated ink jet printing mechanism 33C, a magenta ink-dedicated ink jet printing mechanism 33M, a yellow ink-dedicated ink jet printing mechanism 33Y, and a black ink-dedicated ink jet printing mechanism 33K, sequentially from an upstream side in a running direction of the continuous paper W, respectively. Further, the first printing mechanism area 31 and the second printing mechanism area 32 may include at least one ink jet printing mechanism 33, and may also include more than four inkjet printing mechanisms 33. Further, the shown digital printing unit 3 includes a first drying mechanism 34 for drying a print surface of the continuous paper W printed by the first printing mechanism area 31 and a second drying device 35 for drying a print surface of the continuous paper W printed by the second printing mechanism area 32, between the first printing mechanism area 31 and the second printing mechanism area 32.

Furthermore, the shown digital printing unit 3 has a guide path of the continuous paper W formed by guide members 36, for example, guide rollers or the like, such that a surface of the continuous paper W may run while facing an ink discharge nozzle at a lower side of the first printing mechanism area 31 and the second printing mechanism area 32, that is, at a downward location spaced apart by a predetermined distance from the ink discharge nozzle of the ink jet head of the cyan ink-dedicated ink jet printing mechanism 33C, the magenta ink-dedicated ink jet printing mechanism 33M, the yellow ink-dedicated ink jet printing mechanism 33Y, and the black ink-dedicated ink jet printing mechanism 33K, respectively. This guide path goes through, sequentially, the first printing mechanism area 31, the first drying mechanism 34, the second printing mechanism area 32, and the second drying device 35. Further, a drag roller mechanism 37 for withdrawing and delivering the continuous paper W is installed at a proper location of the corresponding guide path.

The print paper surface monitoring unit 9 includes a rotary roller 91, monitoring mechanisms 92R, 92G, 92B, and 921 installed by approaching monitoring function parts on an outer circumferential surface of the rotary roller 91, and a continuous paper guide path where the continuous paper W printed and dried by the digital printing unit 3 is wound by a predetermined angle on the rotary roller 91 such that the monitored paper surface is on the outer side.

The angle bar mechanism 8 includes a first angle bar 81 installed to be parallel to a paper surface of the continuous paper W guided from the continuous paper supply unit 2 via the digital printing unit 3 or inclined at 45 degrees with respect to the guide direction of the continuous paper W, and a second angle bar 82 installed at the same height as or in parallel to the first angle bar 81 at a location spaced apart from the first angle bar 81 by a proper distance in a direction perpendicular to the guide direction of the continuous paper W.

The section formation unit 4 forming the first downstream unit row together with the section block formation unit 5 and the section block folding-in-two unit 6 is installed at a downstream side of the first angle bar 81 of the angle bar mechanism 8. The section formation unit 4 includes a drag roller mechanism 41 for retracting the continuous paper W passing through the print paper surface monitoring unit 9 and avoiding the angle bar mechanism 8 into the section formation unit 4. A jaw folding mechanism 45 having a cutting cylinder 42, a folding cylinder 43, a jaw cylinder 44 disposed such that outer circumferential surfaces thereof are close to each other, and driven and rotated about an axis perpendicular to the running direction of the continuous paper W and parallel to a surface of the running continuous paper W is installed at a downstream side of the drag roller mechanism 41. A delivery mechanism 46 for delivering a signature-shaped section 48 formed by the jaw folding mechanism 45 to a downstream side is installed at a downstream side of the jaw folding mechanism 45.

The cutting cylinder 42 has a cutting edge (not shown) on an outer circumferential surface thereof. In the present exemplary embodiment, an outer circumferential size of the cutting cylinder 42 is substantially the same as a length by which the continuous paper W is cut.

An outer circumferential size of the folding cylinder 43 is substantially twice of the cutting cylinder 42, and has edge receivers (not shown) capable of receiving an end of the cutting edge at two places dividing bisecting the outer circumferential surface of the folding cylinder 43. Further, a paper end holding mechanism (not shown) is installed near the edge receivers. Further, two foldable blade mechanism (not shown) are installed at substantially bisectional locations between installation locations of the paper end holding mechanism in a circumferential direction of the folding cylinder 43.

The paper end holding mechanism has a plurality of paper holding needles mounted at a predetermined interval in an axial direction of a support shaft in the support shaft installed in the folding cylinder 43 to be parallel to the axial direction of the folding cylinder 43, and is installed such that the tip ends of the paper holding needles may protrude or retract from an outer circumferential surface of an upstream side near the edge receivers on an outer circumferential surface of the folding cylinder 43 in a rotating direction of the folding cylinder 43 along reciprocating angular displacements of the support shafts. The foldable blade mechanism has a foldable blade mounted to a blade support shaft installed in the folding cylinder 43 to be parallel to the axial direction of the folding cylinder 43, and is installed such that the tip end of the foldable blade may protrude or retract in a substantially bisectional location between the protruding and retracting portions of the tip end of the paper holding needle on an outer circumferential surface of the folding cylinder 43 along a reciprocating angular displacement of the blade support shaft.

The paper end holding mechanism has a needle driving mechanism (not shown) for protruding and retracting the tip end of the paper holding needle from an outer circumferential surface of the folding cylinder 43, and the foldable blade mechanism has a blade driving mechanism (not shown) for protruding and retracting the tip end of the foldable blade from an outer circumferential surface of the folding cylinder 43.

The needle driving mechanism is fixedly installed to a frame (not shown) rotatably supporting the folding cylinder 43, and the cam follower associated with the needle support shaft traveling about the axis of the folding cylinder 43 as the folding cylinder 43 rotates moves along an outer circumferential surface thereof, and angularly displaces the needle support shaft by one reciprocation as the folding cylinder 43 rotates once, a tip end of the paper holding needle is installed to be angularly displaced at a desired timing about the axes of the fixing cam formed to be recessed once from the outer circumferential surface of the folding cylinder 43 and the folding cylinder 43 at a predetermined rotation phase of the folding cylinder, and a masking cam is installed to suppress recession from the outer circumferential surface of the folding cylinder 43 at a tip end of the paper holding needle by the angular displacement. An angular displacement driving means (not shown) of a masking cam may be a proper means, such as a link mechanism or a rack/pinion mechanism driven by, for example, a hydraulic cylinder and a servo motor, and the angular displacement driving means is operated by an operational signal output at a desired timing designated and set in advance.

The blade driving mechanism is fixedly installed to a frame (not shown) rotatably supporting the folding cylinder 43, and the cam follower associated with the blade support shaft traveling about the axis of the folding cylinder 43 as the folding cylinder 43 rotates moves along an outer circumferential surface thereof, and angularly displaces the blade support shaft by one reciprocation as the folding cylinder 43 rotates once, a tip end of the folding blade is installed to be angularly displaced at a desired timing about the axes of the fixing cam formed to be recessed once from the outer circumferential surface of the folding cylinder 43 and the folding cylinder 43 at a predetermined rotation phase, and a masking cam is installed to suppress protrusion from the outer circumferential surface of the folding cylinder 43 at a tip end of the folding blade by the angular displacement. An angular displacement driving means (not shown) of a masking cam may be a proper means, such as a link mechanism or a rack/pinion mechanism driven by, for example, a hydraulic cylinder and a servo motor, and the angular displacement driving means is operated by an operational signal output at a desired timing designated and set in advance.

An outer circumferential size of the jaw cylinder 44 is substantially the same size as that of the folding cylinder 43, and has jaw mechanisms (not shown) at two places dividing bisecting the outer circumferential surface of the jaw cylinder 44.

The jaw mechanism has a plate member mounted to a plate member support shaft installed in the jaw cylinder 44 to be parallel to the axial direction of the jaw cylinder 44, and the plate member is installed to be capable of approaching, contacting, or separating from the block member installed by fixing the jaw cylinder 44 opposite to the plate member along a reciprocating angular displacement of the plate member support shaft. Further, as the plate member approaches or contacts the block member, an intermediate part in the cutting lengthwise direction of a single or plurality of sheets 47 formed by cutting the continuous paper W protruding from an outer circumferential surface of the folding cylinder 43 with the foldable blade of the folding cylinder 43 is sandwiched and received, and the sheets 47 form a signature-shaped section 48 folded in two at the intermediate part thereof. In the present exemplary embodiment, the jaw cylinder 44 may continuously receive a single or plurality of sheets 47 having the same configuration as those formed by cutting the continuous paper W from the folding cylinder 43, and the jaw cylinder 44 having continuously received the two sheets 47 having the same configuration may release the two signature-shaped sections 48 having the same configuration toward the delivery mechanism 46 described below while being rotated once after the reception.

The jaw mechanism has a plate member driving mechanism (not shown) for allowing the plate member to approach or contact the block member.

The plate member driving mechanism is fixed to and installed in the frame (not shown) for rotatably supporting the jaw cylinder 44, and has a fixing cam formed such that the cam follower associated with the plate member support shaft traveling around the axis of the jaw cylinder 44 as the jaw cylinder 44 is rotated is moved along the outer circumferential surface thereof by angularly reciprocating and displacing the plate member support shaft, and allows the plate member to approach or contact the block member.

Further, the plate member may have a width slightly smaller than a width size of the sheet 47 with which at least the jaw mechanism is jawed in the axial direction of the jaw cylinder 44, and may be divided to be installed or may be integrally installed, and in general, at least the tip end of the plate member is properly divided to be installed.

The delivery mechanism 46 includes a delivery conveyor 46A. The delivery conveyor 46A has an upper conveyor 46*a* and a lower conveyor 46*b* where carrying surfaces face each other and the facing carrying surfaces are displaced in the same direction, and the signature-shaped section 48 released by the jaw mechanism of the jaw cylinder 44 is sandwiched and carried between the upper conveyor 46*a* and the lower conveyor 46*b* to be delivered to a downstream side.

The section block formation unit 5 includes a carrying mechanism 51 formed by the section formation unit 4, for receiving and carrying the signature-shaped section 48, a section block formation mechanism 52 for stacking a previously-specified set quantity of signature-shaped sections 48, and a delivery mechanism 53 for delivering the formed section block 55 to a downstream side.

The carrying mechanism 51 includes an upstream carrying conveyor 51*a* for receiving and carrying the signature-shaped section 48 delivered from the delivery mechanism 46 of the section formation unit 4, a first downstream carrying conveyor 51*b* and a second downstream carrying conveyor 51*c* installed to be branched out from a downstream end of the upstream carrying conveyor 51*a*. A discharge means 51*d* for discharging a signature-shaped section 48 having a certain problem, such as a printing problem or a folding problem, is installed at an upstream side of the upstream carrying conveyor 51*a*. Further, a switching means 51*e* for introducing the signature-shaped section 48 carried by the upstream carrying conveyor 51*a* to the first downstream carrying conveyor 51*b* is installed at an upstream end of the first downstream carrying conveyor 51*b*. Further, the carrying mechanism 51 is installed to operate the switching means 51*e* such that the two signature-shaped sections 48 continuously released by the jaw cylinder 44 of the section formation unit 4 are carried one by one by the first downstream carrying conveyor 51*b* and the second downstream carrying conveyor 51*c*, respectively. Further, the carrying speeds of the first downstream carrying conveyor 51*b* and the second downstream carrying conveyor 51*c* are controlled such that the signature-shaped sections 48 carried by both the first downstream carrying conveyor 51*b* and the second downstream carrying conveyor 51*c* substantially simultaneously reach a first section block formation mechanism 52A or a second section block formation mechanism 52B installed to correspond to the signature-shaped sections 48 to be described below, respectively.

In the section block formation mechanism 52, the first section block formation mechanism 52A is installed at a downstream side of the first downstream carrying conveyor 51*b* and the second section block formation mechanism 52B is installed at a downstream side of the second downstream carrying conveyor 51*c*. Each of the first section block formation mechanism 52A and the second section block formation mechanism 52B has a rectangular parallelepiped space having a horizontal bottom surface, which is restricted by restriction members for restricting at least three adjacent surfaces. Further, the bottom surface restricting member for restricting the horizontal bottom surface is installed to be moved between a restricting location for restricting the horizontal bottom surface and an opening location for releasing the horizontal bottom surface. A movement driving unit (not shown) of the bottom surface restricting member may be a proper means, such as a link mechanism or a rack/pinion mechanism driven by, for example, a hydraulic cylinder and a servo motor, and the movement driving unit is operated by an operational signal output at a timing designated and set in advance. Further, in the present exemplary embodiment, considering that the first section block formation mechanism 52A and the second section block formation mechanism 52B are installed along a delivery direction of the delivery mechanism 53 described below, the operation of the movement driving means of the bottom surface restricting member is substantially simultaneously performed in the first section block formation mechanism 52A and the second section block formation mechanism 52B.

The delivery mechanism 53 includes a carrying conveyor 53A which can be operated intermittently. The carrying conveyor 53A is installed such that the section block 55 discharged as the first section block formation mechanism 52A and the second section block formation mechanism 52B open the horizontal bottom surface is received on the carrying surface while the section block 55 is stopped, and the received section block 55 is carried to a downstream side through an operation at a proper timing after the reception. Further, a downstream side of the delivery mechanism 53 is configured as a conveyor 53B which can stand by. While the section block 55 formed by the first section block formation mechanism 52A is folded in two by the section block folding-in-two unit 6 to be described below if necessary, the conveyor 53B is installed to stop the section block 55 formed by the second section block formation mechanism 52B such that the section block 55 stands by.

The section block folding-in-two unit 6 may include a chopper folding mechanism 61, for example, as in the shown exemplary embodiment. The chopper folding mechanism 61 includes a chopper folding blade 61*a*, a drive means 61*b* of the chopper folding blade 61*a*, a folding roller pair 61*c*, a delivery fan 61*d*, and a carry-out conveyor 61*e*. The chopper folding mechanism 61 is installed to be operated at a proper timing after the section block 55 carried from the section block formation unit 5 reaches a predetermined chopper folding location.

The sheet formation integration unit 7 forming the second downstream unit row is installed at a downstream side of the second angle bar 82 of the angle bar mechanism 8. The sheet formation integration unit 7 includes a first drag roller mechanism 71 and a second drag roller mechanism 72 for inserting the continuous paper W passing through the print paper surface monitoring unit 9 and guided to the guide path of the continuous paper W branched by the angle bar mechanism 8. Further, the guide path of the continuous paper W is horizontally changed at a downstream side of the second drag roller mechanism 72, and the horizontal guide path is sandwiched such that a sheet formation mechanism 73 including a fixing blade installed to exceed a paper width of the continuous paper W at a lower side, and a rotary blade installed to exceed a paper width of the continuous paper W at an upper side is installed. The rotary blade of the sheet formation mechanism 73 is fixed to a support body rotatable about an axis parallel to a paper surface of the continuous paper W guided by the guide path or perpendicular to the guide direction, and sandwiches the continuous paper W on the guide path of the continuous paper W as the support body rotates, approaches the fixing blade closest and contacts the fixing blade, and cuts the sandwiched continuous paper W to form a single sheet-shaped print product 79. Further, the support body may relatively change a rotating speed of the rotary blade with respect to the movement speed of the continuous paper W moving along the guide path of the continuous paper W to change a cutting interval of the single sheet-shaped print product 79 formed by cutting the continuous paper W, that is, a length of the single sheet-shaped print product 79 in the movement direction of the continuous paper W to a desired length.

Further, a first carrying mechanism 74 and a second carrying mechanism 75 which are carrying mechanisms for carrying the single sheet-shaped print product 79 formed by cutting the continuous paper W with the sheet formation mechanism 73 are installed at a downstream side of the sheet formation mechanism 73, and a sheet stacking mechanism 76 for stacking and integrating the single sheet-shaped print product 79 is installed at a downstream side of the second carrying mechanism 75.

The first carrying mechanism 74 and the second carrying mechanism 75 are driven to be operated at substantially the same speed, and the speed is slightly higher than the speed of the continuous paper W run by the second drag roller mechanism 72.

The sheet stacking mechanism 76 has a bottom surface and two side surfaces perpendicular to the bottom surface or perpendicular to each other, which are restricted by a restricting member, and has a space for stacking the single sheet-shaped print product 79 whose upper side is released, and is configured so that a side surface restricting location can be changed by the restricting member of the restricting members for the two side surfaces, for restricting a downstream side of at least the single sheet-shaped print product 79 in the carrying direction. Further, the sheet stacking mechanism 76 is configured to move the bottom surface restricting member upward and downward. The movement driving means for the bottom surface restricting member may be a proper means, for example, a rack/pinion mechanism driven by, for example, a hydraulic cylinder or a servo motor, and the movement driving means is operated by an operational signal output according to an amount of the single sheet-shaped print products 79 stacked in the space for stacking the single sheet-shaped print product 79. Further, the sheet stacking mechanism 76 is configured to displace a location of at least the bottom surface restricting member on a downstream side in the carrying direction of the single sheet-shaped print product 79 upward and downward, and maybe installed to adjust a downward inclination situation on a downstream side of the bottom surface restricting member.

Next, a production operation of the print product by the above-described print product production device 1 according to the present exemplary embodiment will be described.

The tension of the continuous paper W extracted from the paper roll 21 supported by the continuous paper supply unit 2 is adjusted by the tension adjusting means installed in the in-feed mechanism 22, and the continuous paper W is carried to the digital printing unit 3. Along the guide path formed by the guide members 36, 36, . . . , the continuous paper W carried by the digital printing unit 3 is sequentially guided to lower sides of the four ink jet printing mechanisms 33 of the first printing mechanism area 31, that is, the cyan ink-dedicated ink jet printing mechanism 33C, the magenta ink-dedicated ink jet printing mechanism 33M, the yellow ink-dedicated ink jet printing mechanism 33Y, and the black ink-dedicated ink jet printing mechanism 33K first, and printing is performed on one surface of the continuous paper W by the cyan, magenta, yellow, and black inks. The continuous paper W on one surface of which printing is performed is subsequently guided to the first drying mechanism 34, and the one surface on which printing is performed by the first printing mechanism area 31 is dried. Thereafter, after the continuous paper W is guided to an upper side of the second printing mechanism area 32 and goes beyond the four ink jet printing mechanisms 33 installed in the second printing mechanism area 32, and then is sequentially guided to lower sides of the four ink jet printing mechanisms 33 of the second printing mechanism area 32, that is, the cyan ink-dedicated ink jet printing mechanism 33C, the magenta ink-dedicated ink jet printing mechanism 33M, the yellow ink-dedicated ink jet printing mechanism 33Y, and the black ink-dedicated ink jet printing mechanism 33K, from an opposite side. The continuous paper W is overturned by the guide, and an opposite surface of the continuous paper W faces ink discharge holes of the four ink jet printing mechanism 33 of the second printing mechanism area 32, and printing is performed on the opposite surface by the cyan, magenta, yellow, and black inks. The continuous paper W on the opposite surface of which printing is performed is subsequently guided to the second drying device 35, and the opposite surface on which printing is performed by the second printing mechanism area 32 is dried. The running of the continuous paper W in the digital printing unit 3 is smoothly performed by pulling the continuous paper W with the drag roller mechanisms 37 installed at necessary places in the digital printing unit 3. Further, when the opposite surface of the continuous paper W is not printed, the continuous paper W having gone through the first drying mechanism 34 may be guided to the section formation unit 4 without going through the second printing mechanism area 32 and the second drying device 35.

The continuous paper W on which required printing and drying are performed by the digital printing unit 3 is subsequently guided to the print paper surface monitoring unit 9. The print paper surface monitoring unit 9 is guided while being wound on the rotary roller 91 by a predetermined angle such that a monitored paper surface of the continuous paper W after the printing and drying is located on an outer side, and as the rotary roller 91 is driven and rotated, the continuous paper W is retracted into the print paper surface monitoring unit 9. Further, the monitored paper surface of the continuous paper W moving as the rotary roller 91 rotates is monitored by the monitoring mechanisms 92R, 92G, 92B, and 921 where a monitoring function unit is installed close to an outer circumferential surface of the rotary roller 91. That is, all the monitoring mechanisms 92R, 92G, 92B, and 921 irradiate electromagnetic waves of a predetermined wavelength to a monitored paper surface, respectively, and receive the electromagnetic waves reflected from the monitored paper surface. Further, the received electromagnetic wave data is introduced into and processed by a processing unit (not shown), and an error detection signal is output when an error in a printing state of the monitored paper surface is detected. The corresponding error detection signal is properly used in outputting an alarm and the like.

The continuous paper W having gone through the print paper surface monitoring unit 9 is guided to the section formation unit 4. In the section formation unit 4, the drag roller mechanism 41 retracts the continuous paper W, and carries the continuous paper W between the cutting cylinder 42 and the folding cylinder 43.

The section formation unit 4 is rotated and driven such that circumferential surfaces of the cutting cylinder 42, the folding cylinder 43, and the jaw cylinder 44 which face each other to be close to each other are displaced in the same direction. Further, in the section formation unit 4, the cutting blade of the cutting cylinder 42 and a blade receiver of the folding cylinder 43 are coupled to each other at a location where the cutting cylinder 42 and the folding cylinder 43 face each other, the sheet 47 maybe transferred by the folding blade mechanism of the folding cylinder 43 and the jaw mechanism of the jaw cylinder 44 at a location where the folding cylinder 43 and the jaw cylinder 44 face each other at a mutual phase, the cutting cylinder 42, the folding cylinder 43, and the jaw cylinder 44 are rotated at substantially the same circumferential surface speed, the continuous paper W carried between the cutting cylinder 42 and the folding cylinder 43 is held by the paper holding needle as the paper holding needle protruding from the circumferential surface of the folding cylinder 43 to the tip end side first is driven, and a downstream location near the held location is cut by coupling the cutting blade to the blade receiver. For every half a rotation of the folding cylinder 43, the continuous paper W is held by the paper holding needle and the continuous paper W is cut by coupling the cutting blade to the blade receiver, and the sheet 47 is overlapped for every half a circumferential surface of the folding cylinder 43.

While the sheet 47 is overlapped, the needle driving mechanism is angularly displaced to a location where the masking cam blocks the tip end of the paper holding needle from being recessed from an outer circumferential surface of the folding cylinder 43, and a tip end side of the paper holding needle is not recessed from the outer circumferential surface of the folding cylinder 43. Likewise, the blade driving mechanism is angularly displaced to a location where the masking cam blocks the tip end of the folding blade from protruding from an outer circumferential surface of the folding cylinder 43, and a tip end side of the folding blade does not protrude from an outer circumferential surface of the folding cylinder 43.

If the number of overlapping sheets 47 reaches a desired number designated and set in advance, the folding cylinder 43 transfers the sheet 47 overlapping on an outer circumferential surface thereof to the jaw mechanism of the jaw cylinder 44.

That is, if the number of overlapping sheets 47 reaches a previously designated set number, an operational signal is output from a controller (not shown). Then, in the needle driving mechanism and the blade driving mechanism, the angular displacement driving means of the masking cam is operated, the masking cam of the needle driving mechanism is angularly displaced about an axis of the folding cylinder 43 such that the tip end of the paper holding needle is not blocked from being recessed from an outer circumferential surface of the folding cylinder 43, and the masking cam of the blade driving mechanism is angularly displaced about the axis of the folding cylinder 43 such that the tip end of the folding blade is not blocked from protruding from the outer circumferential surface of the folding cylinder 43. Under this state, if the folding cylinder 43 is rotated once, in the corresponding rotation, the tip end of the paper holding needle is recessed from the outer circumferential surface of the folding cylinder 43 and the tip end of the folding blade protrudes from the outer circumferential surface of the folding cylinder 43. Then, the sheet 47 overlapping on the outer circumferential surface of the folding cylinder 43 is released from the paper holding needle, and the corresponding sheet 47 protrudes such that an intermediate part in the cutting lengthwise direction is isolated radially from the outer circumferential surface of the folding cylinder 43 by the folding blade, and at a location where a plate member of the jaw mechanism of the jaw cylinder 44 approaches or contact a block member. Further, the intermediate part protruded by the folding blade is sandwiched by the plate member and the block member, and received and jaw-folded by the jaw folding mechanism, and a folded point parallel to a shaft of the jaw cylinder 44 is formed at a central portion of the sheet 47, such that the signature-shaped folding-in-two section 48 is formed.

The jaw cylinder 44 of the section formation unit 4 is rotated while maintaining a relationship with the folding cylinder 43 in aspects of rotating direction, rotating speed, and rotation phase, and the plate member of the jaw mechanism repeatedly approaches or contacts and isolates from the block member at a tip end thereof through an operation of the plate member driving mechanism in every rotation. The plate member driving mechanism is installed such that when the tip end side of the plate member approaches or contacts the block member, the approaching or contacting location faces a protruding location of the folding blade of the folding cylinder in the rotation phase of the jaw cylinder, and an approaching or contacting state of the tip end of the plate member and the block member may be maintained until the jaw cylinder 44 is further rotated to reach a rotation phase where the jaw mechanism sufficiently reaches the delivery mechanism 46. Thus, whenever the tip end side of the folding blade protrudes from the outer circumferential surface of the folding cylinder 43 and the sheet 47 released from the paper holding needle protrudes toward the jaw mechanism of the jaw cylinder 44, the jaw mechanism jaw-folds the sheet 47 protruding with the plate member and the block member, and forms the signature-shaped section 48 and guides the signature-shaped section 48 to the delivery mechanism 53.

The delivery mechanism 53 sandwiches the signature-shaped section 48 guided from the jaw cylinder 44 between the upper conveyor 46*a* and the lower conveyor 46*b*, and carries the signature-shaped section 48 to a downstream side while more strongly deforming a folded point formed through the jaw folding.

Further, the number of overlapping sheets 47 may be designated and set to a desired number which is an integer not less than one in advance.

The signature-shaped section 48 formed by the section formation unit 4 reaches the carrying mechanism 51 of the section block formation unit 5 with the delivery mechanism 46 of the section formation unit 4. In the carrying mechanism 51, a discharge means 51*d* which can be displaced between a posture where a carrying surface of a conveyor continuously forms a normal carrying line on a downstream side and a posture where the carrying surface of the conveyor deviates from the normal carrying line is installed at an upstream side of the upstream carrying conveyor 51*a*, and by bringing the carrying surface of the discharge means 51*d* into a posture where the carrying surface of the discharge means 51*d* deviates from the normal carrying line, a section (not shown) which does not have a desired number of overlapping sheets 47 generated during printing, or a section (not shown) including an error problem caused by any trouble of the upstream unit is removed from a normal carrying line. The normal signature-shaped section 48 is carried to a downstream side by an upstream carrying conveyor 51*a*, and reaches a branch part of a first downstream carrying conveyor 51*b* and a second downstream carrying conveyor 51*c* installed continuously from the upstream conveying conveyor 51*a*. The signature-shaped section 48 having reached the branch part is alternately and selectively guided to any one of the first downstream carrying conveyor 51*b* and the second downstream carrying conveyor 51*c* by a switching operation of the switching means 51*e* installed in the branch part. The carrying speeds of the first downstream carrying conveyor 51*b* and the second downstream carrying conveyor 51*c* are different so that the signature-shaped section 48 carried by the two conveyors reaches the section block formation mechanism 52 at substantially the same timing. That is, the two signature-shaped sections 48 and 48 having the same configuration continuously conducted to the jaw cylinder 44 by the folding cylinder 43 of the section formation unit 4 are guided to the first downstream carrying conveyor 51*b* and the second downstream carrying conveyor 51*c*, respectively, one by one through a switching operation of the switching means 51*e*, and a timing when the signature-shaped section 48 carried by the first downstream carrying conveyor 51*b* reaches the first section block formation mechanism 52A installed at a downstream of the first downstream carrying conveyor 51*b*, and a timing when the signature-shaped section 48 carried by the second downstream carrying conveyor 51*c* reaches the second section block formation mechanism 52B installed at a downstream of the second downstream carrying conveyor 51*c* is made substantially the same. In this way, it is important that the two signature-shaped sections 48 and 48 are installed to reach the section block formation mechanism 52 corresponding thereto at the substantially the same timing, in order not to generate an error when the section block 55 is carried to a downstream side which will be described below.

The signature-shaped section 48 carried to the first section block formation mechanism 52A or the second section block formation mechanism 52B is formed in the section block 55 by the first section block formation mechanism 52A or the second section block formation mechanism 52B, respectively. Here, the section block 55 is formed in the same way by the first section block formation mechanism 52A and the second section block formation mechanism 52B, and thus the forming of the section block 55 in the section block formation mechanism 52 will be described.

The signature-shaped sections 48 having reached the section block formation mechanism 52 are discharged into a rectangular parallelepiped space whose four side surfaces and horizontal bottom surface are restricted by restricting members, and are stacked while adjacent two sides thereof are adjusted in the space, forming the section block 55. If the stacked signature-shaped sections 48 reach a desired number previously designated and set and a target section block 55 is formed, the formed section blocks 55 are discharged from the rectangular parallelepiped space. That is, if the number of stacked signature-shaped sections 48 reaches a previously designated set number, an operational signal is output from a controller (not shown). Then, the movement driving means of the restricting member restricting the horizontal bottom surface of the section block formation mechanism 52 is operated, the restricting member restricting the horizontal bottom surface is moved to an opening location for opening the horizontal bottom surface of the rectangular parallelepiped space, and the section block 55 formed in the rectangular parallelepiped space is discharged to a lower side.

In the present exemplary embodiment, since the first section block formation mechanism 52A and the second section block formation mechanism 52B are installed along a delivery direction of the delivery mechanism 53, the operation of the movement driving means of the restricting member restricting the horizontal bottom surface is substantially simultaneously performed in the first section block formation mechanism 52A and the second section block formation mechanism 52B. Further, the number of overlapping signature-shaped sections 48 may be designated and set to a desired number which is an integer not less than one in advance.

The section block 55 discharged from the section block formation mechanism 52 is received by the carrying surface of the carrying conveyor 53A of the delivery mechanism 53 installed at a lower side of the section block formation mechanism 52. The carrying conveyor 53A is stopped when receiving the section block 55, and after receiving the section block 55, the carrying conveyor 53A is operated at a proper timing and carries the received section block 55 to a downstream side.

When carrying the section block 55, the carrying conveyor 53A simultaneously carries the two section blocks 55 and 55 discharged from the first section block formation mechanism 52A and the second section block formation mechanism 52B. However, lest the two section blocks 55 and 55 should be simultaneously present in the section block folding-in-two unit 6 installed at a downstream side of the section block formation unit 5, while the section block 55 formed by the first section block formation mechanism 52A carried to a downstream side in the carrying direction while folded in two by the section block folding-in-two unit 6, the section block 55 formed by the second section block formation mechanism 52B is stopped and stood by on the carrying surface of the standby conveyor 53B which is a downstream part of the delivery mechanism 53 if necessary.

The section block 55 having reached the chopper folding mechanism 61 which is the section block folding-in-two unit 6 with the delivery mechanism 53 is retracted to a predetermined folding-in-two location of the section block support plate (not shown) by a retracting means (not shown) of the chopper folding mechanism 61. Then, the drive means 61*b* is operated, and the chopper folding blade 61*a* is reciprocated upward and downward, tapping substantially a central widthwise location of the section block 55 retracted to the folding-in-two location from the upper side. The section block 55 tapped by the chopper folding blade 61*a* is press-fitted to a lower side from an opening formed in the section block support plate, and a central widthwise location thereof is inserted between close outer circumferential surfaces of the folding roller pair 61*c* installed by disposing close parts on the outer circumferential surface thereof on a lower side of the opening such that the counterpart circumferential surfaces of the folding roller pair 61*c* are displaced and rotated to a lower side.

The section block 55 a central widthwise location of which is inserted between the folding roller pair 61*c* is sandwiched by the folding roller pair 61*c* to be folded in two at a central widthwise location, and is discharged to a lower side by the rotation of the folding roller pair 61*c*, and a signature-shaped print product 65 whose section block 55 is folded in two is formed. The signature-shaped print product 65 discharged by the folding roller pair 61*c* is received by the delivery fan 61*d* installed at a lower side of the folding roller pair 61*c*, reaches the carry-out conveyor 61*e* due to the rotation of the delivery fan 61*d*, is transferred from the delivery fan 61*d* to the carrying conveyor 61*e*, and is carried out from the print product production device 1 by the conveying conveyor 61*e*.

Meanwhile, after printed and dried by the digital printing unit 3 and passing through the print paper surface monitoring unit 9, the continuous paper W guided to a guide path of the continuous paper W branched by the angle bar mechanism 8 is retracted into the sheet formation integration unit 7 by the first drag roller mechanism 71 and the second drag roller mechanism 72 and is guided to a horizontal guide path of the continuous paper W at a downstream side of the second drag roller mechanism 72. Further, the moving continuous paper W guided to the horizontal guide path of the continuous paper W sandwiches the horizontal guide path, and is cut to have a desired movement direction size by the sheet formation mechanism 73 including the fixing blade installed to exceed the paper width of the continuous paper W on a lower side and the rotary blade installed to exceed the paper width of the continuous paper W on an upper side, and thus a single sheet-shaped print product 79 having a desired size is formed.

The single sheet-shaped print product 79 formed by the sheet formation mechanism 73 is carried to the sheet stacking mechanism 76 for stacking and integrating the single sheet-shaped print product 79 by the first carrying mechanism 74 and the second carrying mechanism 75. Here, the carrying speeds of the first carrying mechanism 74 and the second carrying mechanism 75 are set to be higher than the moving speed of the continuous speed W due to the first drag roller mechanism 71 and the second drag roller mechanism 72, and thus a predetermined interval is generated between the front and rear single sheet-shaped print products 79 as the print products 79 are carried by the first carrying mechanism 74 and the second carrying mechanism 75.

The single sheet-shaped print products 79 carried while the predetermined interval is generated therebetween by the first carrying mechanism 74 and the second carrying mechanism 75 are discharged into a space (stacking space) of the sheet stacking mechanism 76 installed at a downstream side thereof, for stacking the single sheet-shaped print products 79 from the second carrying mechanism 75 and are stacked in the space.

In stacking the single sheet-shaped print product 79, in the stacking space of the sheet stacking mechanism 76, a side surface restricting location by a restricting member for restricting a downstream side of the single sheet-shaped print product 79 in the carrying direction in correspondence to the movement direction size of the stacked single sheet-shaped print products 79 is changed. Further, the single sheet-shaped print product 79 having reached the stacking space is stacked while the two adjacent sides thereof are adjusted by fine vibrations of the side restricting member for restricting two adjacent side surfaces perpendicular to the bottom surface of the stacking space. Further, the bottom surface restricting member of the stacking space is lowered according to the amount of the single sheet-shaped print products 79 stacked in the stacking space based on a preset control reference. Thus, the single sheet-shaped print products 79 having reached the stacking space are not stacked while exceeding an upper end of the side surface restricting member.

If the single sheet-shaped print products 79 stacked in the stacking space reaches a predetermined amount, the stacked single sheet-shaped print products 79 are discharged from the stacking space through a proper means or method.

Further, by adjusting a downstream downward inclination situation of the bottom surface restricting member according to an original strength of a paper or a strength of a paper changed according to a printing state, the single sheet-shaped print product 79 can be stacked in the stacking space more efficiently. Further, in branching the guide path of the continuous paper to a downstream side of the digital printing unit 3, as the first downstream unit row and the second downstream unit row are installed in parallel at a downstream side of the digital printing unit 3 and the continuous paper guide path is branched by installing the angle bar mechanism 8 at a branch point, the guide path of the continuous paper to the second downstream unit row can be made shorter as compared with the case where the first downstream unit row and the second downstream unit row are branched as a path exceeding the first downstream unit row by installing the first downstream unit row and the second downstream unit row in series at a downstream side of the digital printing unit 3, and thus it is possible to reduce papers damaged when the single sheet-shaped print product 79 is produced.

Although the print product production device according to the present invention has been described with reference to the shown embodiment, the present invention is not limited to the shown embodiment but may be variously modified within a range satisfying the claims.

For example, if unnecessary, the print paper surface monitoring unit 9 installed at a downstream side of the digital printing unit 3 may be omitted.

Further, in the section block folding-in-two unit 6, the retraction means of the chopper folding mechanism 61 may extend to exceed a predetermined folding-in-two location of the section block support plate, and the section block 55 formed by the section block formation unit 5 may be installed to reach a downstream side of the section block folding-in-two unit 6 while not being folded in two.

Further, in the sheet formation integration unit 7, a carry-out mechanism for carrying out the single sheet-shaped print product 79 overlapping in the stacking space of the sheet stacking mechanism 76 may be installed at a downstream side of the sheet stacking mechanism 76.

[Industrial Applicability]

The present invention is available as a print product production device which can selectively produce a print product obtained by digitally printing a continuous paper, cutting the continuous paper, and folding and binding a cut paper sheet, for example, a signature-shaped print product such as a newspaper, and a print product obtained by digitally printing and cutting a continuous paper, for example, a single sheet-shaped print product such as a direct mail or an advertisement.

[Reference Signs List]

1: Print product production device
2: Continuous paper supply unit
21: Paper roll
22: In-feed mechanism
3: Digital printing unit
31: First printing mechanism area
32: Second printing mechanism area
33: Ink jet printing mechanism
33C: Cyan ink-dedicated ink jet printing mechanism
33M: Magenta ink-dedicated ink jet printing mechanism
33Y: Yellow ink-dedicated ink jet printing mechanism
33K: Black ink-dedicated ink jet printing mechanism
34: First drying mechanism
35: Second drying mechanism
36: Guide member
37: Drag roller mechanism
4: Section formation unit
41: Drag roller mechanism

42: Cutting cylinder
43: Folding cylinder
44: Jaw cylinder
45: Jaw folding mechanism
46: Delivery mechanism
46A: Delivery conveyor
46*a*: upper conveyor
46*b*: Lower conveyor
47: Sheet
48: Signature-shaped section
5: Section block formation unit
51: Carrying mechanism
51*a*: upper carrying conveyor
51*b*: First downstream carrying conveyor
51*c*: Second downstream carrying conveyor
51*d*: Discharge means
51*e*: Switching means
52: Section block formation mechanism
52A: First section block formation mechanism
52B: Second section block formation mechanism
53: Delivery mechanism
53A: Carrying conveyor
53B: Conveyor
55: Section block
6: Section block folding-in-two unit
61: Chopper folding mechanism
61*a*: Chopper folding blade
61*b*: Drive means
61*c*: Folding roller pair
61*d*: Delivery fan
61*e*: Carrying conveyor
65: Signature-shaped print product
7: Sheet formation integration unit
71: First drag roller mechanism
72: Second drag roller mechanism
73: Sheet formation mechanism
74: First carrying mechanism (Carrying mechanism)
75: Second carrying mechanism (Carrying mechanism)
76: Sheet stacking mechanism
79: Single sheet-shaped print product
8: Angle bar mechanism
81: First angle bar
82: Second angle bar
9: Print paper surface monitoring unit
91: Rotary roller
92R, 92G, 92B, 921: Monitoring mechanisms
W: Continuous paper

The invention claimed is:

1. A print product production device comprising: a continuous paper supply unit; a digital printing unit; a section formation unit; a section block formation unit; a section block folding-in-two unit; and a sheet formation integration unit, the print product production device being configured to guide the continuous paper of the continuous paper supply unit to the digital printing unit via a continuous paper guide path and process the continuous paper, wherein the continuous paper guide path having gone through the digital printing unit from the continuous paper supply unit is installed to be branched at a downstream side of the digital printing unit into two continuous paper guide paths, one continuous paper guide path guides the continuous paper to the section formation unit, and the section block formation unit and the section block folding-in-two unit are disposed at a downstream side of the section formation unit, and the other continuous paper guide path guides the continuous paper to the sheet formation integration unit;

wherein the section formation unit includes a jaw folding mechanism having a cutting cylinder, a folding cylinder, and a jaw cylinder driven and rotated about axes parallel to each other, and a first folding is executed by jaw folding through a cooperation of the folding cylinder and the jaw cylinder to form a section; and wherein the sheet formation integration unit includes:

a sheet formation mechanism having a rotary blade which is driven and rotated about an axis perpendicular to a direction where the continuous paper guided to a continuous paper guide path is guided and parallel to the paper surface of the continuous paper and installed to exceed a paper width of the continuous paper, and a fixing blade installed to exceed a paper width of the continuous paper on an opposite side of the rotary blade by sandwiching the continuous paper guide path, a sheet stacking mechanism installed at a downstream side of the sheet formation mechanism, and a carrying mechanism for carrying the sheet formed by the sheet forming mechanism toward the sheet stacking mechanism, and wherein sheets are formed by cutting the continuous paper to be substantially parallel to a width wise direction of the continuous paper at a location where the rotary blade is rotated to approach the fixing blade closest, and the sheets are stacked by a sheet stacking mechanism.

2. The print product production device of claim 1, wherein an angle bar mechanism is installed at a branch part of the continuous paper guide path, and the continuous paper is optionally guided to any one of the one continuous paper guide path and the other continuous paper guide path after the branching.

3. The print product production device of claim 1, wherein the operation in which a number of overlapping sheets constituting the section is designated, and the first folding is executed by the jaw folding through the cooperation of the folding cylinder and the jaw cylinder of the section formation unit to form the section is executed when the folding cylinder is rotated by the same number as the designated number of overlapping sheets constituting the section, after the operation in which a preceding section is formed.

4. The print product production device of claim 1, wherein an outer circumferential length of the folding cylinder is integer times as long as a cutting length by which the continuous paper is cut into sheets, and when -the a first stage is executed by the jaw folding through the cooperation of the folding cylinder and the jaw cylinder to form the section, sections the number of which amounts to the integer for one rotation of the folding cylinder are continuously formed.

5. The print product production device of claim 4, further comprising:

a designation means for designating the number of overlapping sheets constituting the section, wherein an operation in which the first stage is executed by jaw folding through a cooperation of the folding cylinder and the jaw cylinder in the section formation unit to form a section is executed whenever the folding cylinder is rotated by the same number as the number of overlapping designated sheets.

6. The print product production device of claim 1, wherein an outer circumferential length of the folding cylinder is Integer times as long as a length by which die continuous paper is cut, and when a first stage is executed by the jaw folding through the cooperation of the folding cylinder and the jaw cylinder to form the section, sections the number of which amounts to the integer for one rotation of the folding cylinder are continuously formed, and the section block formation unit includes section block formation mechanisms the number of which amounts to the integer, and the section block formation mechanisms form a section block together.

7. The print product production device of claim 1, wherein the sheet formation mechanism relatively changes a rotating speed of the rotary blade with respect to a movement speed of the continuous paper moving along the guide path of the continuous paper to change a cutting length (a length of the continuous paper in the movement direction) of the formed sheets.

8. The print product production device of claim 1, wherein the sheet stacking mechanism has a sheet stacking space where a bottom surface and two side surfaces perpendicular to the bottom surface and perpendicular to each other are restricted by restricting members and an upper side is released, and a side surface restricting location by the restricting member of the restriction members of the two side surfaces which restricts at least a downstream side of the sheet in the carrying direction is to be changed.

9. The print product production device of claim 8, wherein the sheet stacking mechanism moves the bottom surface restricting member upward and downward.

10. The print product production device of claim 8, wherein the sheet stacking mechanism displaces at least a downstream location of the sheet of the bottom surface restricting member.

11. A print product production device comprising: a continuous paper supply unit; a digital printing unit; a section formation unit; a section block formation unit; a section block folding-in-two unit; and a sheet formation integration unit, the print product production device being configured to guide the continuous paper of the continuous paper supply unit to the digital printing unit via a continuous paper guide path and process the continuous paper, wherein the continuous paper guide path having gone through the digital printing unit from the continuous paper supply unit is installed to be branched at a downstream side of the digital printing unit into two continuous paper guide paths, one continuous paper guide path guides the continuous paper to the section formation unit, and the section block formation unit and the section block folding-in-two unit are disposed at a downstream side of the section formation unit, the other continuous paper guide path guides the continuous paper to the sheet formation integration unit, wherein an angle bar mechanism is installed at a branch part of the continuous paper guide path, and the continuous paper is optionally guided to any one of the one continuous paper guide path and the other continuous paper guide path after the branching, wherein the section formation unit includes a jaw folding mechanism having a cutting cylinder, a folding cylinder, and a jaw cylinder driven and rotated about axes parallel to each other, and first folding is executed by jaw folding through a cooperation of the folding cylinder and the jaw cylinder to form a section, wherein the operation in which a number of overlapping sheets constituting the section, is designated to a desired number, and the first folding is executed by the jaw folding through the cooperation of the folding cylinder and the jaw cylinder of the section formation unit to form the section is executed when the folding cylinder is rotated by the same number as the designated desired number of overlapping sheets constituting the section, after the operation in which a preceding section is formed; and wherein the sheet formation integration unit includes:

a sheet formation mechanism having a rotary blade which is driven and rotated about an axis perpendicular to a direction where the continuous paper guided to a continuous paper guide path is guided and parallel to the paper surface of the continuous paper and installed to exceed a paper width of the continuous paper, and a fixing blade installed to exceed a paper width of the continuous paper on an opposite side of the rotary blade by sandwiching the continuous paper guide path, a sheet stacking mechanism installed at a downstream side of the sheet formation mechanism, and a carrying mechanism for carrying the sheet formed by the sheet forming mechanism toward the sheet stacking mechanism, and wherein sheets are formed by cutting the continuous paper to be substantially parallel to a width wise direction of the continuous paper at a location where the rotary blade is rotated to approach the fixing blade closest, and the sheets are stacked by a sheet stacking mechanism.

* * * * *